US007625152B2

(12) United States Patent
Swamidass

(10) Patent No.: US 7,625,152 B2
(45) Date of Patent: Dec. 1, 2009

(54) PREFABRICATED PLASTIC RAISED RUMBLE STRIPS AND EDGE LINE FOR ROADWAYS

(76) Inventor: Paul M. Swamidass, 1529 Ferndale Dr., Auburn, AL (US) 36832

( * ) Notice: Subject to any disclaimer, the term of this patent is extended or adjusted under 35 U.S.C. 154(b) by 0 days.

(21) Appl. No.: 11/907,834

(22) Filed: Oct. 17, 2007

(65) Prior Publication Data

US 2008/0095575 A1 Apr. 24, 2008

Related U.S. Application Data

(60) Provisional application No. 60/853,145, filed on Oct. 19, 2006.

(51) Int. Cl.
*E01F 9/047* (2006.01)

(52) U.S. Cl. ..... 404/12; 404/15

(58) Field of Classification Search ..... 404/12, 404/15, 16

See application file for complete search history.

(56) References Cited

U.S. PATENT DOCUMENTS

| | | | | | |
|---|---|---|---|---|---|
| 1,265,404 | A * | 5/1918 | Tuteur | 404/15 |
| 1,357,860 | A * | 11/1920 | Freeman | 238/3 |
| 1,740,501 | A * | 12/1929 | Eckstrand | 404/16 |
| 1,843,746 | A * | 2/1932 | Tibbetts | 404/15 |
| 4,135,839 | A * | 1/1979 | Engwall | 404/16 |
| 5,242,242 | A * | 9/1993 | Young | 404/12 |
| 5,582,490 | A * | 12/1996 | Murray | 404/90 |
| 5,769,563 | A * | 6/1998 | Flynn | 404/15 |
| 5,775,834 | A * | 7/1998 | Jackson | 404/15 |
| 6,259,374 | B1 * | 7/2001 | Kisner et al. | 340/905 |
| 6,309,137 | B1 * | 10/2001 | Hirsch | 404/15 |
| 7,168,886 | B2 * | 1/2007 | Loader | 404/75 |
| 2003/0194271 | A1 * | 10/2003 | Solon | 404/15 |
| 2008/0260458 | A1 * | 10/2008 | Fillie | 404/16 |

* cited by examiner

*Primary Examiner*—Gary S Hartmann

(57) ABSTRACT

A roadway safety warning device, preferably in the form of a continuous, integrated, prefabricated, plastic, raised rumble strip (IPPRRS), preferably pigmented to serve as edge lines as well as a continuous shoulder rumble strip (CSRS), for roadways, including but not limited to highways, county roads, and streets. It is preferably provided as a strip which has a series of first areas and second areas, the first areas having a first height, the second areas having a second height, and the second height being different than the first height. The first and second areas extend substantially across the width of the strip. The first and second areas alternate substantially along the length of the strip. The strip is made of an abrasion-resistant material and bonded to the pavement. The devise warns the driver of the vehicle riding on it.

15 Claims, 6 Drawing Sheets

Side view

PREFABRICATED PLASTIC RAISED RUMBLE STRIPS AND EDGE LINE FOR ROADWAYS

CROSS-REFERENCE TO RELATED APPLICATION

This patent application claims the benefit of U.S. Provisional Patent Application 60/853,145, filed Oct. 19, 2006.

BACKGROUND

1. The USA has millions of miles of roadways without Continuous Shoulder Rumble Strips (CSRS) to warn drivers involuntarily leaving the highway resulting in injury, death and property damage. Conventionally, CSRS are formed in-situ in highway pavement surfaces with alternating grooves and ridges.

2. Throughout the USA, county highways rarely have shoulders and lack CSRS. However, these highways permit speeds in excess of 50 mph. At night, or when visibility is poor, or when the driver is distracted, even in broad daylight, the potential for leaving the pavement or veering into oncoming traffic is high.

3. Single vehicle run-off-the-road (SVROTR) crashes are preventable using continuous rumble strips along highways. However, millions of miles of highways do not have CSRS.

4. Continuous shoulder rumble strips (CSRS) are a countermeasure used by highway agencies to prevent single-vehicle run-off-the-road crashes. CSRS are part of highway shoulder and may run parallel to the direction of traffic for the entire length of the highway. In Illinois, the CSRS are rolled into the hot pavement mix as part of resurfacing and shoulder rehabilitation projects. The standard depth of Illinois' CSRS is 1.9 cm (0.75 in.) with a width of 0.9 m (3 ft.) and a spacing of 20.27 cm (8 in.). The outside boundary of the CSRS is 30.41 cm (12 in.) from the edge line. Another approach is to "mill-in" the CSRS after the shoulder surface has hardened.

5. "Noise and vibration produced by shoulder rumble strips are effective alarms for drivers who are involuntarily leaving the roadway. They are also helpful in areas where motorists battle rain, fog, snow, or dust. Rumble strips also help reduce highway hypnosis—a condition where white lines and yellow stripes on long, monotonous stretches of straight freeway can mesmerize and wreak havoc with a driver's concentration." Source: Federal Highway Administration (FHWA) website.

6. In the USA, single vehicle run-off-the-road (SVROTR) crashes result in approximately one third of all highway fatalities and one-half million people are injured annually.

7. CSRS alert inattentive drivers. "CSRS are bands of raised material or indentations formed or grooved in the shoulders placed continuously to alert drivers starting to drift off the road. They alert drivers by transmitting sound and vibration through the vehicle." They may be formed on the highway shoulder for the entire length of the highway outside the white or yellow edge line in highways.

8. Benefits of CSRS: 18.3% reduction in SVROTR in all freeways, and 21% reduction in SVROTR in rural freeways. In 1997 dollars, the average comprehensive cost of a SVROTR crash was $62,200.

9. Currently, shoulder rumble strips are either formed on hardtop shoulders or cut into concrete shoulder surfaces. In 1996, in the US, 12,158 fatal crashes were single-vehicle run-off-the-road.

11. Conventional milled or rolled strips on pavement produced in-situ are placed on highway shoulders about 10" to 12" from the white/yellow edge line.

13. Prior art prefabricated, raised rumble strips are made of thermoplastics or asphalt and are placed perpendicular to the flow of traffic across the entire width of the traffic lane. They are bonded to pavement surface by approved adhesives recommended by state or federal transportation agencies. These raised individual strips are placed across the entire width of a lane and/or the width of a shoulder for very SHORT DISTANCES to warn traffic of the imminent need to slow down or stop. These thermoplastic warning strips, of various widths, rise about 12 mm or 13 mm above road surface. These prefabricated, raised rumble strips do not run the length of the highway next to the edge line. For an example, see Florida state highway department web pages. U.S. Pat. No. 4,813,811 (issued Mar. 21, 1989) describes such a prefabricated pavement device. It is a "prefabricated composite pavement devise comprising a pavement mixture layer shaped to predetermined width, thickness and cross-section" that is "arranged perpendicular to the flow of traffic for the entire width of the traffic lane" to warn traffic of an impending need to stop or slow down. Traffic warning strips as shown in U.S. Pat. No. 4,813,811 refer to prefabricated rumble strips placed perpendicularly in the path of the traffic for short distances; it is not a CSRS.

14. U.S. Pat. No. 5,327,850 concerns small, non-metallic, extruded roadway markers that cause noise and rumble when a vehicle travels over them. They are bonded by adhesives to the pavement surface of highways. They help "define traffic lanes, identify obstacles" and serve as a substitute for the commonly used roadway marker formed of ceramic and having a semi-hemispherical or button shape. U.S. Pat. No. 5,327,850 shows that prefabricated rumble strips made of non-metallic plastic materials may be bonded to pavement surfaces by adhesives approved by highway agencies.

15. Existing practices of using milled in-situ or other CSRS described above require a wide highway shoulder to accommodate a separate edge line and a rumble strip.

16. Because millions of miles of highways lack shoulders, and because the cost and time of installing the edge line and milled or other forms of CSRS is prohibitive, today, life- and injury-saving CSRS are not installed in millions of miles of highways. Thousands of drivers are exposed to life-threatening accidents because highways lack CSRS. Further, these accidents are destructive to the vehicles and cause billions of dollars in losses in vehicle and property damage.

17. Current practice of painting edge lines and separately milling or rolling CSRS in-situ is time-consuming and disrupts traffic for long periods of time.

SUMMARY

A roadway safety warning device, preferably in the form of a continuous, integrated, prefabricated, plastic, raised rumble strip (IPPRRS), preferably but not necessarily with pigmented edge lines, for roadways, including but not limited to highways, county roads, and streets. It is preferably provided as a strip which has a series of alternating first areas and second areas, the first areas having a first height, the second areas having a second height, and the second height being different than the first height. The first and second areas extend substantially across the width of the strip. The first and second areas are repeated over and over again substantially over the entire length of the strip. The strip is made of an abrasion-resistant material. The size and shape of the first and second areas, their size and shape with respect to each other, and their angle with respect to the centerline of the roadway, are selected to provide a desired warning signal to a vehicle riding upon the strip so as to alert and warn the driver of the vehicle.

DETAILED DESCRIPTION

Figure 1:
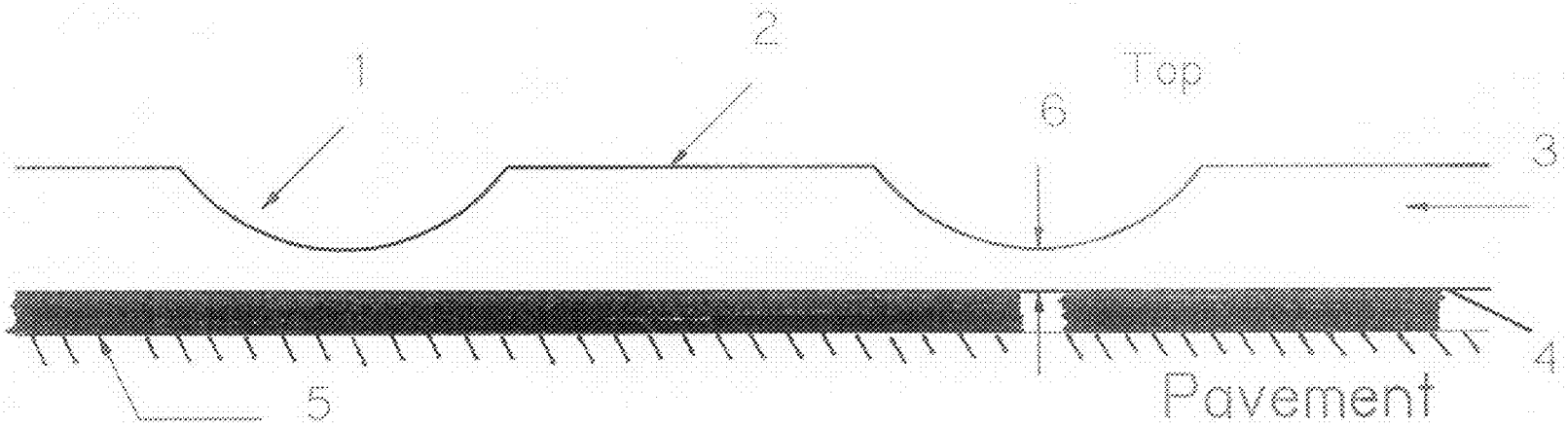
FIG. 1 is a view of an embodiment from either side (left or right side) with curved grooves

1. A white/yellow "corrugated" rumble strip is preferably made of abrasion-resistant polymer (such as nylon, recycled nylon, etc.) that is bonded by adhesives to highways in place of the white or yellow edge line (paint) along the right/left edge of highways. It serves the dual purposes of a white/yellow continuous line on the rightmost/leftmost lane as well as a CSRS on highways with or without shoulders. It enables the creation of continuous rumble trips in shoulder-less highways. It will cause noise, vibrations through the tires/wheels of an errant driver's car to signal unintended and dangerous run-off-the-road accidents.

2. The use of white IPPRRS as edge lines as well as CSRS is most appropriate for highways without adequate shoulders for a painted edge line and for traditional CSRS milled or formed on the shoulder. The yellow IPPRRS may be used in the middle of ALL highways with two-way traffic to warn traffic from one side of traffic veering into oncoming traffic.

3. IPPRRS strips are bonded to the pavement with an adhesive(s) that meets standards prescribed by state Departments of Transportation, and Federal Highway agencies. IPPRRS strips are bonded to the pavement surface along either side of highways for the entire length of the highways. Some, but not all, of the benefits provided by the use of IPPRRS are listed below. These benefits may be used individually or in combinations of two, more, or all, as desired.

a. IPPRRS can serve as white or yellow edge line on the highway to guide traffic, b. IPPRRS can serve as a rumble strip to warn wayward drivers involuntarily leaving the highway to the left or right of the paved highway, c. IPPRRS can enable the installation of rumble strips on highways with no shoulder, or without adequate shoulder room, d. IPPRRS can serve as an inexpensive alternative to separate edge lines and conventional milled rumbled strips that are not integrated with each other, e. IPPRRS can serve as a faster installation alternative to separate edge lines and conventional milled rumble strips that are not integrated with each other, and h. IPPRRS may be mass-produced inexpensively to commonly-approved CSRS dimensions for grooves and ridges obtained from web pages of state and federal highway agencies for their satisfaction.

4. IPPRRS serve a dual purpose; they take the place of the painted edge lines as well as serve as a CSRS to warn drivers leaving the traffic lane unintentionally. The combined cost of conventional paint plus the cost of making in-situ milled rumble strips is likely to be more than the cost for the use of an IPPRRS.

a. The cost of installing edge lines as well as rumble strips in highways is reduced because IPPRRS can be mass produced in a factory by rolling, drawing, stamping, pressing, extruding, and other mass production techniques. Further, the total cost for existing methods of painting an edge line and separately rolling or milling the pavement in-situ to create CSRS is more than IPPRRS mass production and installation costs.

b. IPPRRS can be added to pavement surface in less time compared to the time needed to paint the edge line in one operation, and to "mill" the conventional rumble strips in-situ in a second operation.

c. By mass producing the white/yellow IPPRRS in a manufacturing plant, highway departments could reduce the cost and time of installing both the edge line and CSRS to millions of miles of highways. The disruption to traffic for installing the integrated edge line and rumble strip will be less than the current practice.

d. IPPRRS can be added to pavement surface less expensively compared to the total cost necessary to paint the edge line in one operation, and to mill the conventional rumble strips in-situ in a second operation.

e. IPPRRS may be prefabricated with reflective white/yellow (similar in pigmentation to the white continuous line on the edge of highways, or reflective yellow lines in highways). This appropriately pigmented rumble strip eliminates the need for painting continuous white/yellow line on the right or left edge of highways, thereby providing a cost saving.

f. The pavement surface needed on highways to install both edge lines and CSRS is reduced.

g. IPPRRS may be added to new or existing pavements without shoulders that lack the space on the pavement to accommodate conventional CSRS.

5. IPPRRS, preferably made of plastics/polymers, could be prefabricated by a processes such as rolling, extruding, pressing, or stamping in multiples of 2', 4', 6', 10', etc., or in continuous rolls for easier manual or machine handling/laying by the highway departments. Pigmented or un-pigmented IPPRRS may be mass produced inexpensively in factories in strips of standard and nonstandard lengths. IPPRRS may be mass produced in linear pieces or in selected curved shapes of various radii to suit the curvature of the highways. Further, IPPRRS may be manufactured for adaptation at the site while installing on highway curves.

6. IPPRRS strips could be 4" or more in width and about 1/16" or thicker at the base (0.2" base thickness shown in FIGS. 1 through 3) with corrugations (alternating grooves and ridges) for causing the rumble (indentations or ridges rising about ½" or more above the base; the bottom of the groove is the base). The corrugations run perpendicular to the highway (alternatively, at an inclination to the center of the highway) over the full width of the polymer/thermoplastic strip, the details of which are shown in FIGS. 1 to 5. The strip width, the depth of indentations, the angle of inclination of the indentations to the center of the road, the width of the grooves, etc. may be selected to give any desired sound and vibration effect to the driver to get his/her attention.

7. Width of IPPRRS need not be limited to the width of the white paint commonly found in highways today; strips could be made wider than common painted edge line to get the desired sound and vibration effect.

8. Prefabricated synthetic resins/polymers can reproduce any and all in-situ milled or rolled rumble strip configurations currently used and recommended by national and state highway authorities.

9. Installation: (1) The strips may be applied directly on the road surface with adhesives, or (2) applied on white/yellow highway edge paint before the paint dries; in this case, the paint itself may have adhesive properties; or (3) FIGS. 1 through 5 show a 0.2" layer of adhesive coating at the bottom of the continuous polymer rumble strip; IPPRRS strips may be shipped to the site with adhesive coating pre-applied to the bottom of IPPRRS and a peel-able anti-stick cover; or (4) IPPRRS may be shipped without an adhesive coating. In which case, adhesives approved by transportation agencies may be applied in-situ to bond IPPRRS to the pavement.

a. IPPRRS may be shipped from factories with an adhesive backing. The adhesive on the backing may come with an easily removable "paper-like" thin protective film, which is to be removed before permanently boding the IPPRRS on to the pavement surface using an appropriately weighted roller conforming to state and federal highway standards for laying plastic and other markers on payments. The adhesive preferably conforms to state and federal highway standards for such adhesives.

b. When IPPRRS is shipped with an adhesive coating, at the site, the anti-stick covering from the adhesive may be removed and the rumble strips may be permanently attached to the road surface by heat, pressure, water or other sealing methods including combinations of the various methods approved by state and federal highway agencies.

c. IPPRRS without adhesive backings may be bonded to highway pavement surface using adhesives prescribed by state and federal highway standards for bonding plastic highway markers to the pavement.

10. Yellow line+rumble strips may be used in divided highways on the left edge of the road (in the USA) to warn drivers leaving the pavement on the left.

11. In two-way highways, yellow rumble strips may be used as yellow median lines to alert drivers encroaching on the yellow median and/or veering off into oncoming traffic. These strips could be particularly valuable in alerting drivers in curves on the highway, where cars traveling on the inside curve tend to cross or overshoot the median very often.

12. IPPRRS is placed parallel to traffic along edge lines of the entire highway. The invention described by U.S. Pat. No. 4,813,811 warns drivers of danger ahead, and the impending need to stop or slow down; it is not a CSRS and is not a substitute for IPPRRS.

13. IPPRRS is preferably made of hard plastic to withstand abrasion, thermal cycling, and embody all essential physical characteristics for pavement markers and plastic materials bonded to highway pavements as specified in all state and federal standards (Example, but not limited to: US DOT, Federal Highway Administration, Standards Specification, FP-3).

14. The raised portions on the IPPRRS alternate with grooves (curved grooves shown in FIG. 1; or inverted trapezoidal grooves shown in FIGS. 2 and 3) cause the tires riding on them at any velocity to sink into the grooves and rise back (in rapid up-and-down cycles) per second as a function of the velocity of the vehicle; the faster the vehicle, the higher the rate or cycles per second. The higher the cycles, the more the vibration and noise is imparted to the vehicle to get the attention of the wayward driver.

a. The width and depth of the grooves may be chosen as needed to produce the desired vibration and noise in the vehicle traveling at specified speeds, or to meet vibration and noise standards laid down by state and federal standards.

b. Preformed grooves in IPPRRS (FIGS. 1 through 3) that run laterally are formed throughout the length of the IPPRRS at equal distance from each other during mass production of the IPPRRS.

c. The raised ridges and alternating grooves preformed in the IPPRRS (with curved or inverted trapezoidal grooves in FIGS. 1 and 2) are such as to cause vibration and noise in the vehicle to get the immediate attention of the driver as well as warn the driver that the vehicle is on the verge of leaving the pavement, or is veering off into oncoming traffic (in the case of yellow line between traffic lanes carrying traffic in opposite directions).

d. The raised ridge (or crest) and alternating grooves preformed in the IPPRRS may have curved grooves (FIG. 1), or inverted trapezoidal grooves (FIGS. 2 and 3), or any other geometrical shape to cause desired vibration and noise in the vehicle traveling over them in order to alert and warn the wayward driver.

15. White pigmented IPPRRS may be bonded to the pavement on the RIGHT side of highway in the USA where the traffic flows on the right side of the street; in countries where the traffic flows on the left side of the street, the white pigmented IPPRRS may be bonded to the pavement in the LEFT side of the highway.

16. Yellow pigmented IPPRRS may be bonded to the pavement on the LEFT side of highway in the USA where the traffic flows on the right side of the street; in countries where the traffic flows on the left side of the street, the yellow pigmented IPPRRS may be bonded to the pavement in the RIGHT side of the highway.

17. IPPRRS may also be made of any hard plastic or non-metallic material capable of withstanding weather conditions prescribed by all state and federal highway agencies.

18. IPPRRS is preferably made of any hard plastic or non-metallic material(s) capable of withstanding traffic in freeway speeds for the number of years specified for highway markers made of similar hard materials as prescribed by state and federal highway standards.

19. IPPRRS preferably uses paint pigmentation that is consistent with highway white, highway yellow or any other highway pigmentation standards specified by all state and federal highway agencies.

20. Highway driver and passenger safety are improved by enabling the inexpensive and quick installation of continuous, integrated, preformed non-metallic rumble strips with edge lines on highways with or without shoulders.

21. IPPRRS offers an inexpensive and rapid way of retrofitting millions of miles of highways with a CSRS to prevent accidents on county and other highways that now lack shoulders and CSRS. All new highways without shoulders (and lacking room for CSRS) can be quickly and inexpensively finished with IPPRRS to warn drivers.

22. Accidents, injuries, deaths and property damage on highways resulting from drivers involuntarily leaving highways without continuous rumble strips are prevented and/or reduced by the use of IPPRRS.

23. IPPRRS may be mass produced by any of the methods listed above to create a honeycomb interior in the raised an grooved portions to reduce the weight of IPPRRS and materials used without compromising the structural integrity of the IPPRRS necessary to perform satisfactorily for the many years required by highway agencies.

Figure 6:
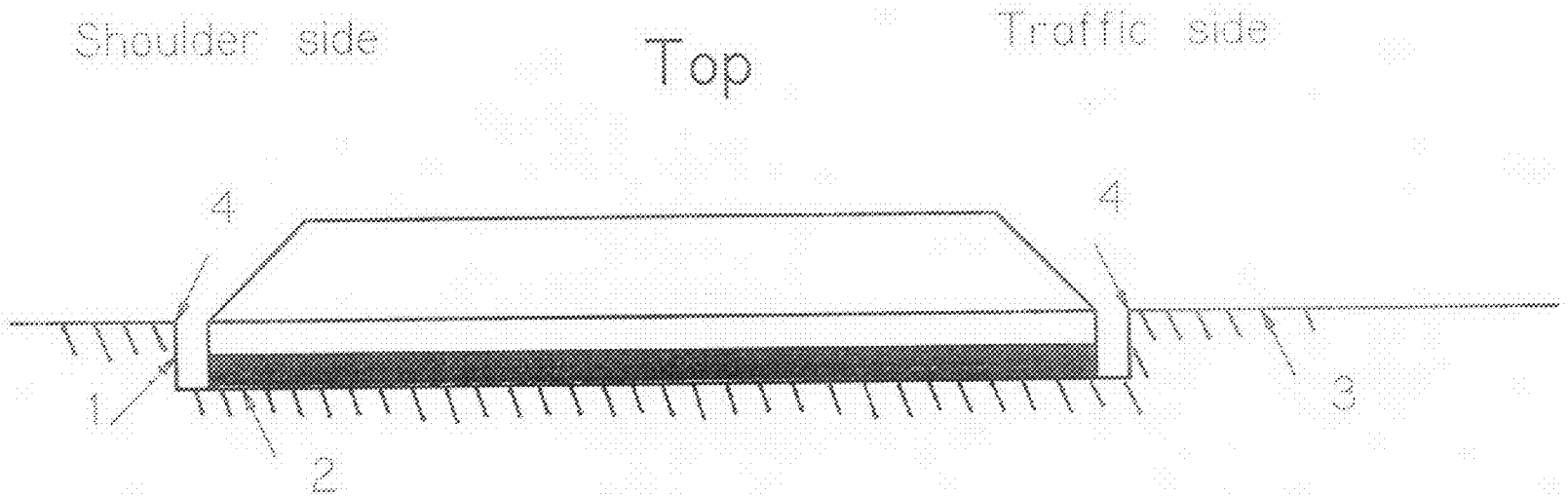
FIG. 6 is an end view of IPPRRS set in a groove or indent formed in the roadway surface.

24. IPPRRS may be bonded to the roadways on a flat roadway surface, or an indentation/groove formed in hot mix, or specifically cut into the road surface to accommodate the IPPRRS. Such a groove on the road surface may to be at least 0.25 inches deep running along the roadway, and at least 0.25 wider than the IPPRRS. FIG. 6 shows an end view of IPPRRS set in a roadway groove of 0.4" depth. FIG. 6 shows an embodiment of IPPRRS set in a groove that has a 0.2" clearance on each side of the IPPRRS.

Embodiments of the invention are illustrated in FIGS. 1 through 6. Various changes could be made, such as, but not limited to the dimensions, and shapes in the figures, without departing from the spirit and scope of this invention.

Figure 2:
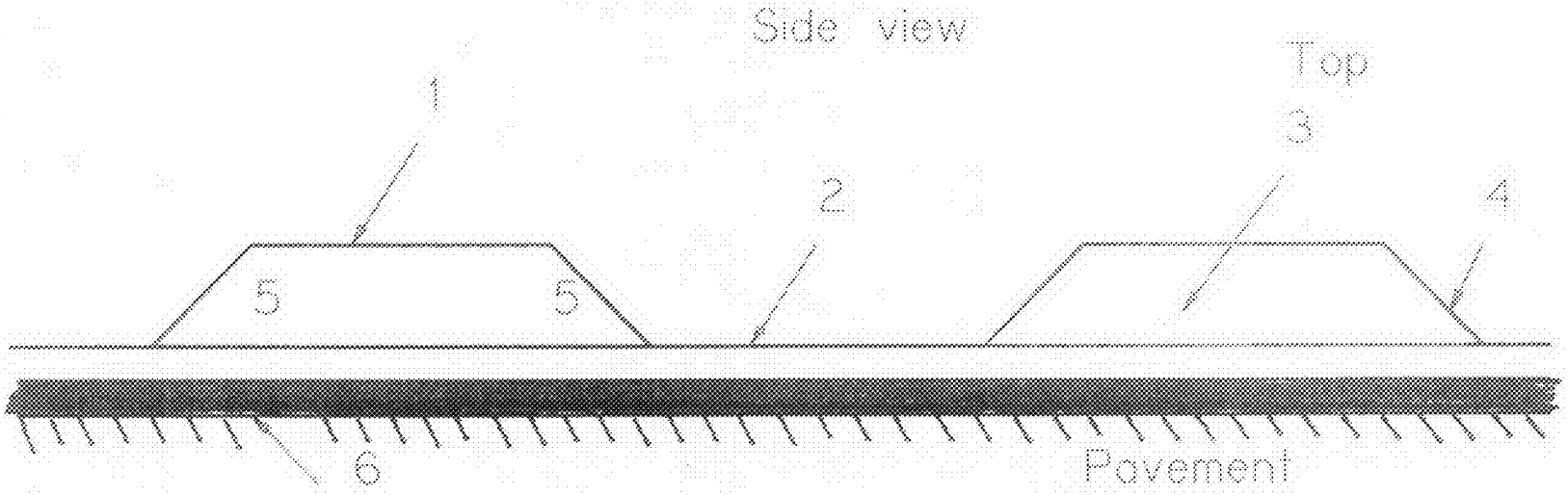
FIG. 2 is a view of an embodiment from either side with trapezoidal grooves
Figure 3:
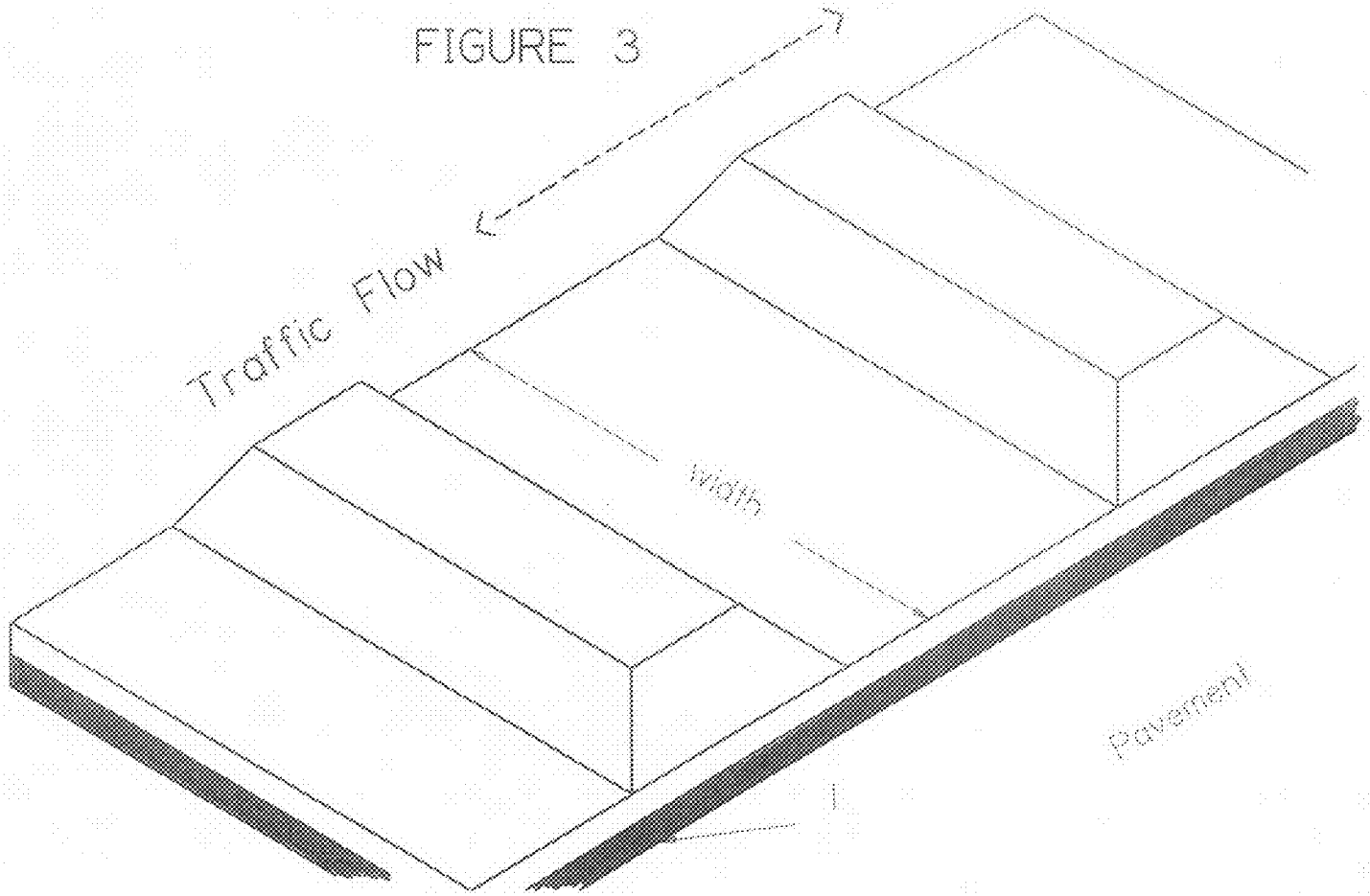
FIG. 3 is a top perspective with trapezoidal grooves
Figure 4:
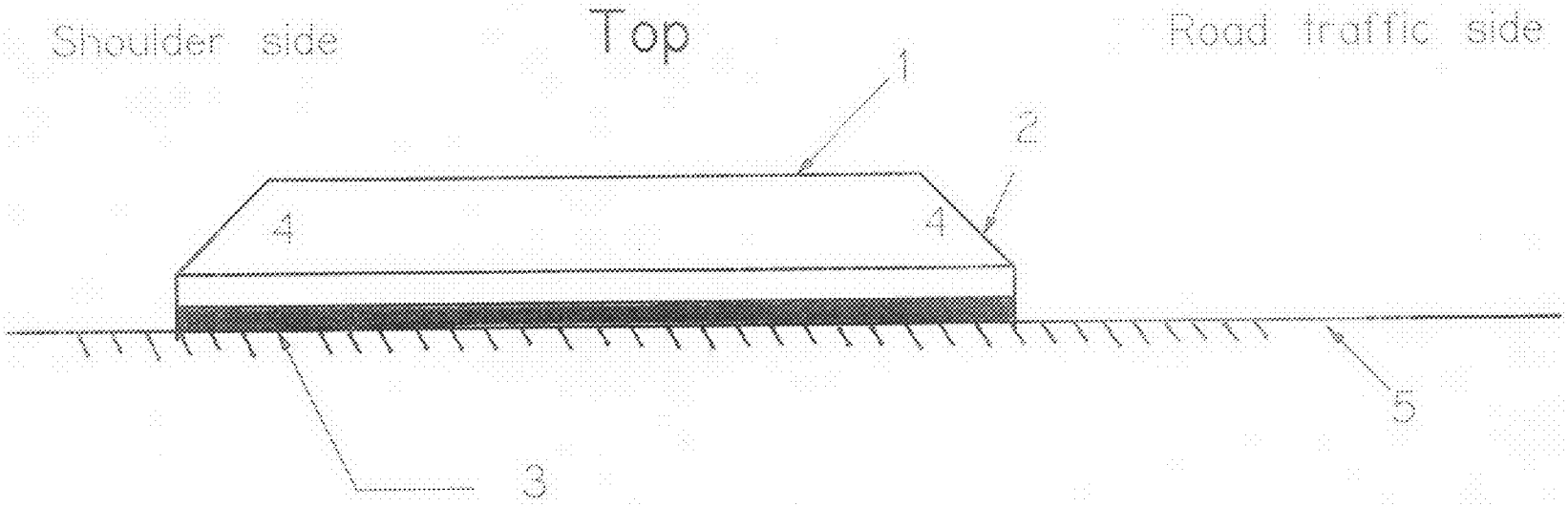
FIG. 4 is an end view (or lateral cross-sectional view) from either end with trapezoidal or curved grooves
Figure 5:
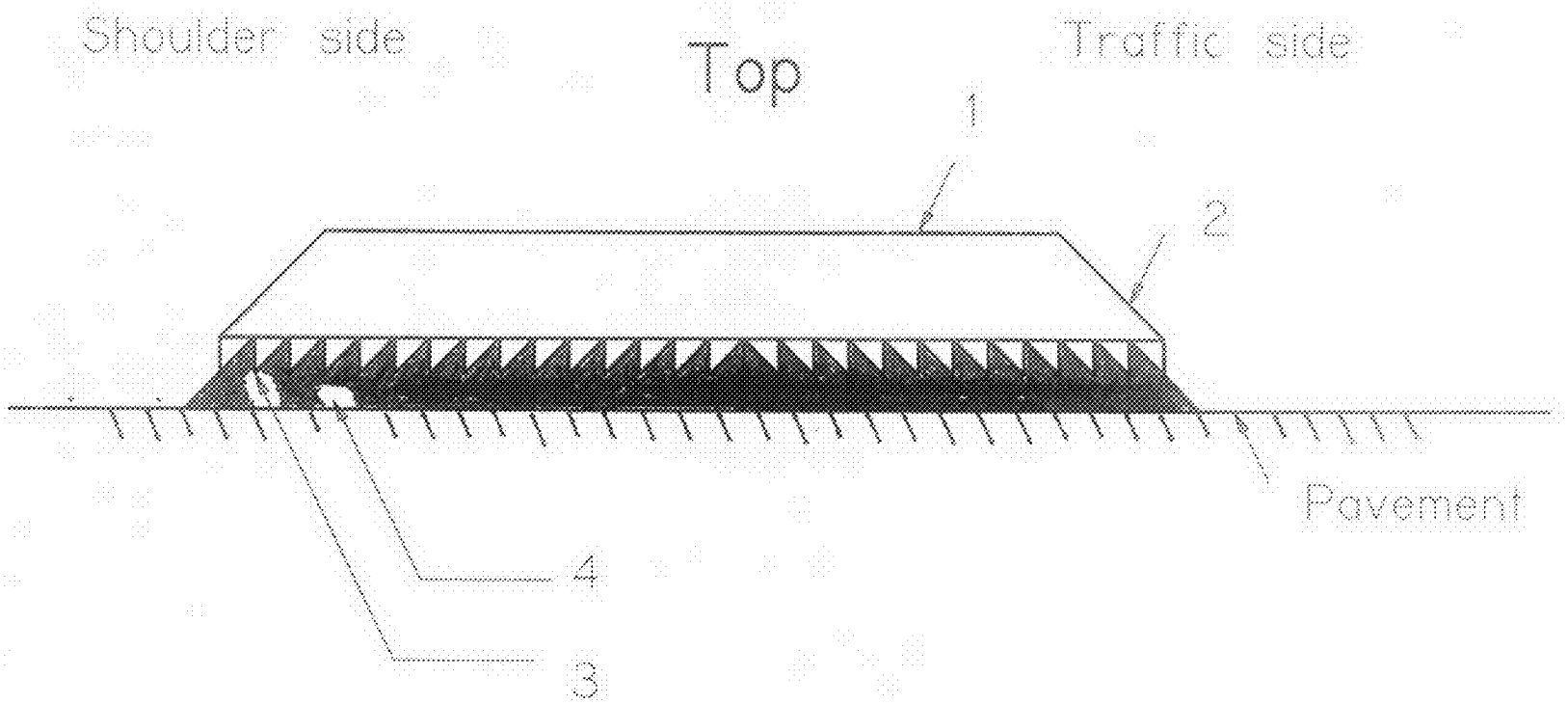
FIG. 5 is an end view (or lateral cross-sectional view) displaying the grooves (run parallel to the center of the highway) on the bottom surface for better adhesion of IPPRRS to the pavement surface. The grooves on the bottom surface in FIG. 5 could be set at an angle to the center line of the highway to vary the bonding of the IPPRRS to the pavement.

FIG. 1 shows the side view of one embodiment where area 1 is lower than area 2, further 3 is the maximum thickness of the strip between area 1 and bottom surface 4 bonded to the pavement using adhesive by 5, and 6 represents the thickness of the strip at the lowest point of lower area 1. The thickness 6 at the lowest point is sufficient to prevent breakage of the strip while handling or in permanent use as a rumble strip bonded to the pavement. FIG. 2, shows a minor modification to FIG. 1 resulting in one of many possible embodiments of the invention where the raised portions have a trapezoidal cross-section. In FIG. 2, area 2 is lower than area 1. Thickness 3 of the raised portion could be varied to achieve desired noise and vibration effect in a vehicle traveling on the rumble strip. In FIG. 2, 4 is the surface joining the lower and upper areas having an acute angle defined by the angle 5. The device is permanently bonded to the pavement with adhesive 6. FIG. 3 is a top perspective of the device in FIG. 2 bonded permanently to the pavement with adhesive 1. In FIG. 4, the top surface 1 of the raised portion slopes down at the edges as represented by surface 2 forming acute angles 4 at the two edges. Further, the device is bonded to the pavement 5 by adhesive 3. FIG. 5, shows a device similar to one represented in FIG. 4 with the addition of grooves 3 in the bottom surface to bond better permanently with the pavement when an adhesive 4 is used. FIG. 6 represents the devise in either FIG. 4 or 5 permanently bonded by adhesive 2 to the pavement 3 in a groove formed or cut in the pavement. The boundaries 4 of the groove in the pavement; the depth of the groove 1 is such that the raised portion of the rumble strip stays above the pavement 3 to cause noise and vibration in vehicles traveling over the device. The width of the groove in the pavement allows approximately 0.25 inch clearance on each side of the device set inside of the pavement groove.

The invention claimed is:

1. A roadway safety warning device for bonding to the highway pavement using an adhesive, comprising:

a strip having a length and a width;

the strip having an alternating series of first areas and second areas, the first areas having a first height, the second areas having a second height, the second height being different than the first height to give a longitudinally corrugated rumble-causing top surface;

the first and second areas extending substantially across the width of the strip;

the first and second areas alternating along substantially the length of the strip such that vibration and noise are caused in the vehicle whose tire rides over the "corrugated" rumble-causing longitudinal top surface of the strip;

and the strip is positioned as a permanent rumbling line that warns drivers of vehicles involuntarily leaving the highway and is bonded to the pavement adjacent to the outer edge of the pavement as a continuous rumbling strip over the entire length or part of the highway.

2. The device of claim 1 wherein the abrasion-resistant material is a selected one of a nylon polymer, a hard plastic, or non-metallic substance.

3. The device of claim 1 wherein the device has a top surface, and the top surface is either traffic white or traffic yellow in color.

4. The device of claim 1, wherein the device has a bottom surface, and further comprising an adhesive on the bottom surface to bond the device to a roadway.

5. The device of claim 1 wherein the difference between the first height and the second height, and the areas of the first height and the second height are selected to impart a warning signal to a vehicle riding upon the device.

6. The device of claim 5 wherein the warning signal is at least one of a noise or a vibration.

7. The device of claim 1 wherein the width is selected to impart a warning signal to a vehicle riding upon the device.

8. The device of claim 7 wherein the width is approximately 4 inches or more.

9. The device of claim 1 wherein the shape of the profiles of the first areas and the second areas is selected to impart a warning signal to a vehicle riding upon the device.

10. The device of claim 9 wherein the shape of the profiles of the first and second areas is a selected one of square, rectangle, a portion of a circle, a portion of an oval, trapezoidal, inverted trapezoidal, grooved, or inverted groove.

11. The device of claim 1 wherein the collective profile of the first areas and the second areas is a corrugated shape having dimensions selected to impart a warning signal to a vehicle riding upon the device.

12. The device of claim 1 wherein the smaller of the first height or the second height is at least 1/20 inch, and the difference between the first height and the second height is approximately 4/10 inch or more.

13. The device of claim 1 wherein the angle of inclination of the first areas and the second areas with respect to the centerline of the roadway is selected to impart a warning signal to a vehicle riding upon the device.

14. The device of claim 1 wherein the device has a top surface, and the top surface has a reflective pigmentation, the reflective pigmentation having a traffic white or traffic yellow color approved by highway authorities.

15. The device of claim 1 may be bonded by adhesives to a flat roadway surface or a roadway surface specifically grooved or indented to receive the device.

* * * * *